US006206462B1

(12) United States Patent
Huang

(10) Patent No.: US 6,206,462 B1
(45) Date of Patent: Mar. 27, 2001

(54) PINCH PREVENTING MECHANISM FOR A COLLAPSIBLE CHAIR

(76) Inventor: Ming-Tai Huang, 4th Floor, No. 302, Cheng Teh Road, Sec. 7, Taipei (TW)

( * ) Notice: Subject to any disclaimer, the term of this patent is extended or adjusted under 35 U.S.C. 154(b) by 0 days.

(21) Appl. No.: 09/550,551

(22) Filed: Apr. 17, 2000

(51) Int. Cl.[7] ..... A47C 4/44

(52) U.S. Cl. ..... 297/39; 297/16.1

(58) Field of Search ..... 297/16.1, 35, 39, 297/40, 41, 46, 47

(56) References Cited

U.S. PATENT DOCUMENTS 3,319,997 * 5/1967 Clement ..... 297/39 X
5,054,848 * 10/1991 Liu ..... 297/39
5,735,570 * 4/1998 Tseng ..... 297/39
6,095,596 * 8/2000 Chen ..... 297/39

* cited by examiner

*Primary Examiner*—Peter R. Brown
(74) *Attorney, Agent, or Firm*—Alan Kamrath; Rider Bennett Egan & Arundel, LLP.

(57) ABSTRACT

A pinch preventing mechanism is provided for a collapsible chair having a backrest frame, a seat frame, two armrests, two front legs, and two rear legs. The pinch preventing mechanism includes a pin fixed to one of the rear legs, a sleeve slidably mounted around the associated rear leg, and an engaging device. The sleeve includes a compartment into which the pin extends. A spring is mounted in the compartment and attached between the pin and an end wall defining the compartment, thereby biasing the sleeve downward. An upper end of the engaging device is pivotally connected to a lower end of an associated lateral side of the backrest frame. A lower end of the engaging device is pivotally connected to the associated rear leg in a position below the sleeve. The engaging device further includes a notch, wherein a wedge formed on the sleeve is engaged in the notch of the engaging device when the collapsible chair is in an extended status. A locking member formed on the sleeve is biased by the spring to securely yet releasably engaged with the upper end of the engaging device when the collapsible chair is in the extended status, thereby preventing collapse of the collapsible chair. When collapsing the collapsible chair, the sleeve is manually moved upward along the associated rear leg to disengage the wedge from the notch. The spring exerts a downward force to the sleeve to make a bottom side of the wedge abut against the engaging device to thereby retain the sleeve at a level in which the locking member of the sleeve disengages from the upper end of the engaging device, thereby allowing collapse of the collapsible chair.

7 Claims, 8 Drawing Sheets

PINCH PREVENTING MECHANISM FOR A COLLAPSIBLE CHAIR

BACKGROUND OF THE INVENTION

1. Field of the Invention

The present invention relates to a pinch preventing mechanism for a collapsible chair.

2. Description of the Related Art

A collapsible chair may be collapsed when not in use. Nevertheless, when sitting in an extended collapsible chair, a user may be injured when he/she leans backward, as front legs of the chair might be moved above the ground and thus cause the chair in a status allowing collapse. In addition, when collapsing the collapsible chair, the fingers of the user are placed on pivotal sections of the collapsible chair and thus might be injured.

The present invention is intended to provide a pinch preventing mechanism for a collapsible chair to solve the above problems.

SUMMARY OF THE INVENTION

A collapsible chair in accordance with the present invention comprises:

a backrest frame including two lateral sides each having a lower end, a seat frame including two lateral sides each having a front end and a rear end, the rear end of each said lateral side of the seat frame including a mounting block securely mounted thereon, the lower end of each said lateral side of the backrest frame being pivotally connected an associated said mounting block, two armrests each having a front end and a rear rend, the rear end of each said armrest being pivotally connected to an intermediate portion of an associated said lateral side of the backrest frame, two front legs each having an upper end and a lower end, the upper end of each said front leg being pivotally connected to the front end of an associated said armrest, two rear legs each having an upper end and a lower end, the upper end of each said rear leg being pivotally connected to an intermediate portion of the associated armrest, a pinch preventing mechanism including:

a pin fixed to one of the rear legs, a sleeve slidably mounted around said one of the rear legs and including a locking member and a wedge, the sleeve including a compartment into which the pin extends, a spring being mounted in the compartment and attached between the pin and an end wall defining the compartment, thereby biasing the sleeve downward, the wedge including a bottom surface, an engaging device including an upper end pivotally connected to said lower end of an associated said lateral side of the backrest frame, the engaging device further including a lower end pivotally connected to said one of the rear legs in a position below the sleeve, the engaging device including a notch, the wedge being engaged in the notch of the engaging device when the collapsible chair is in an extended status, the locking member of the sleeve being biased by the spring to securely yet releasably engaged with the upper end of the engaging device when the collapsible chair is in the extended status, thereby preventing collapse of the collapsible chair, whereby when collapsing the collapsible chair, the sleeve is manually moved upward along said one of the rear legs to disengage the wedge from the notch, the spring exerts a downward force to the sleeve to make the bottom side of the wedge abut against the engaging device to thereby retain the sleeve at a level in which the locking member of the sleeve disengages from the upper end of the engaging device, thereby allowing collapse of the collapsible chair.

The wedge includes an inclined side surface and the notch includes a correspondingly shaped inclined surface. The inclined side surface of the wedge slides along the inclined surface of the notch when collapsing the collapsible chair by moving the sleeve upward along said one of the rear legs. The sleeve further includes a thumb-piece formed on an outer periphery thereof to allow easy upward manual movement of the sleeve along said one of the rear legs. The sleeve may include an end cap mounted to an upper end thereof.

A stop is formed on an outer periphery of said one of the rear legs for retaining the sleeve at a level above the engaging device when the collapsible chair is in a collapsed status, thereby allowing the collapsed chair to be extended directly. The sleeve includes a second compartment in which an upper end wall defining the second compartment abuts against the stop when the collapsible chair is in the collapsed status.

In an embodiment of the invention, the engaging device includes two parallel side plates between which said one of the rear legs extends. Each side plate includes an upper end and a lower end. The upper ends of the side plates of the engaging member are connected by an engaging tube that is integrally formed with the upper ends of the side plates and pivotally connected to the lower end of the associated lateral side of the backrest frame. The lower ends of the side plates of the engaging member are pivotally connected to said one of the rear legs. The notch is defined in one of the side plates of the engaging member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
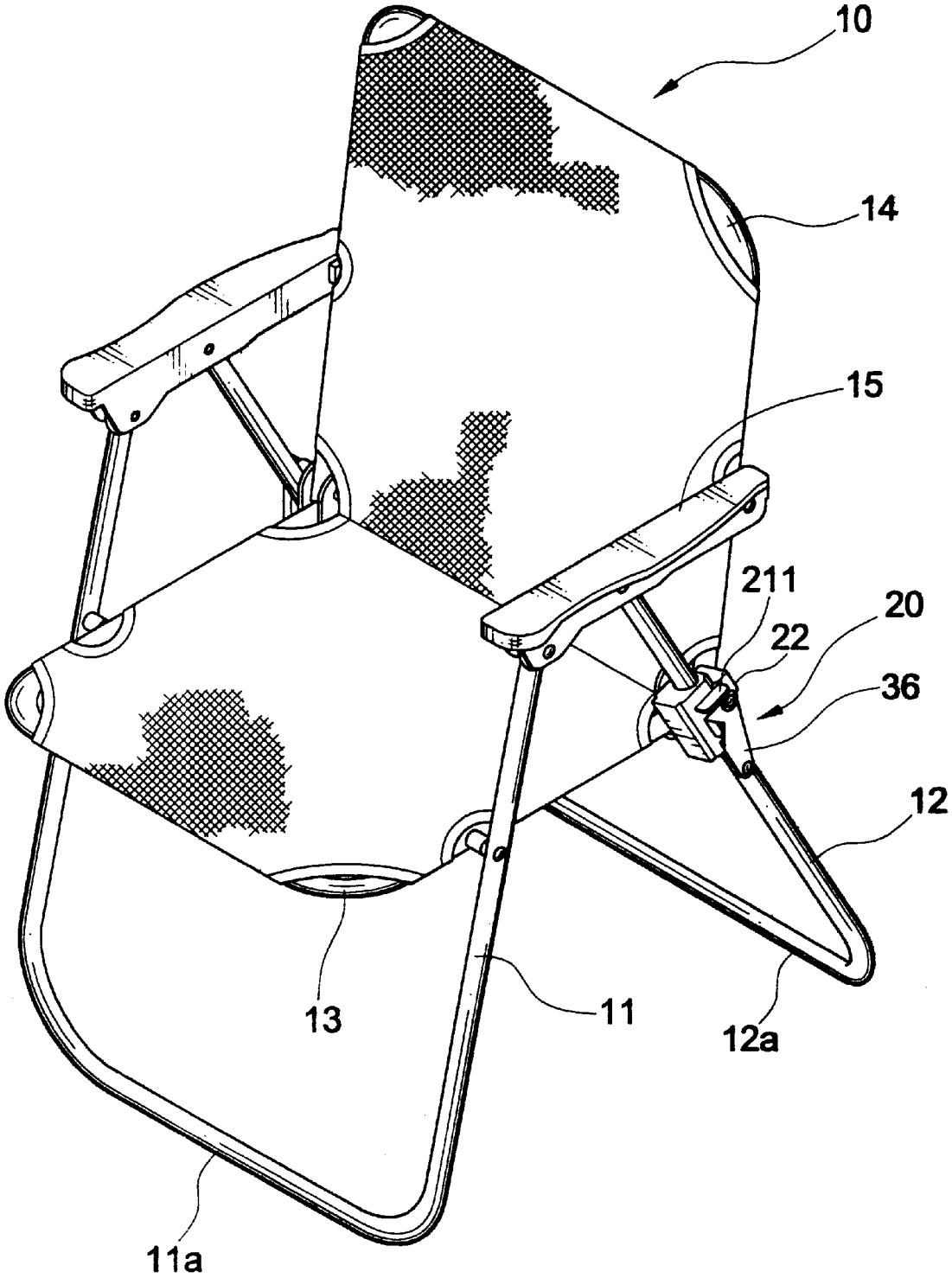
FIG. 1 is a perspective view of a collapsible chair in accordance with the present invention.
Figure 2:
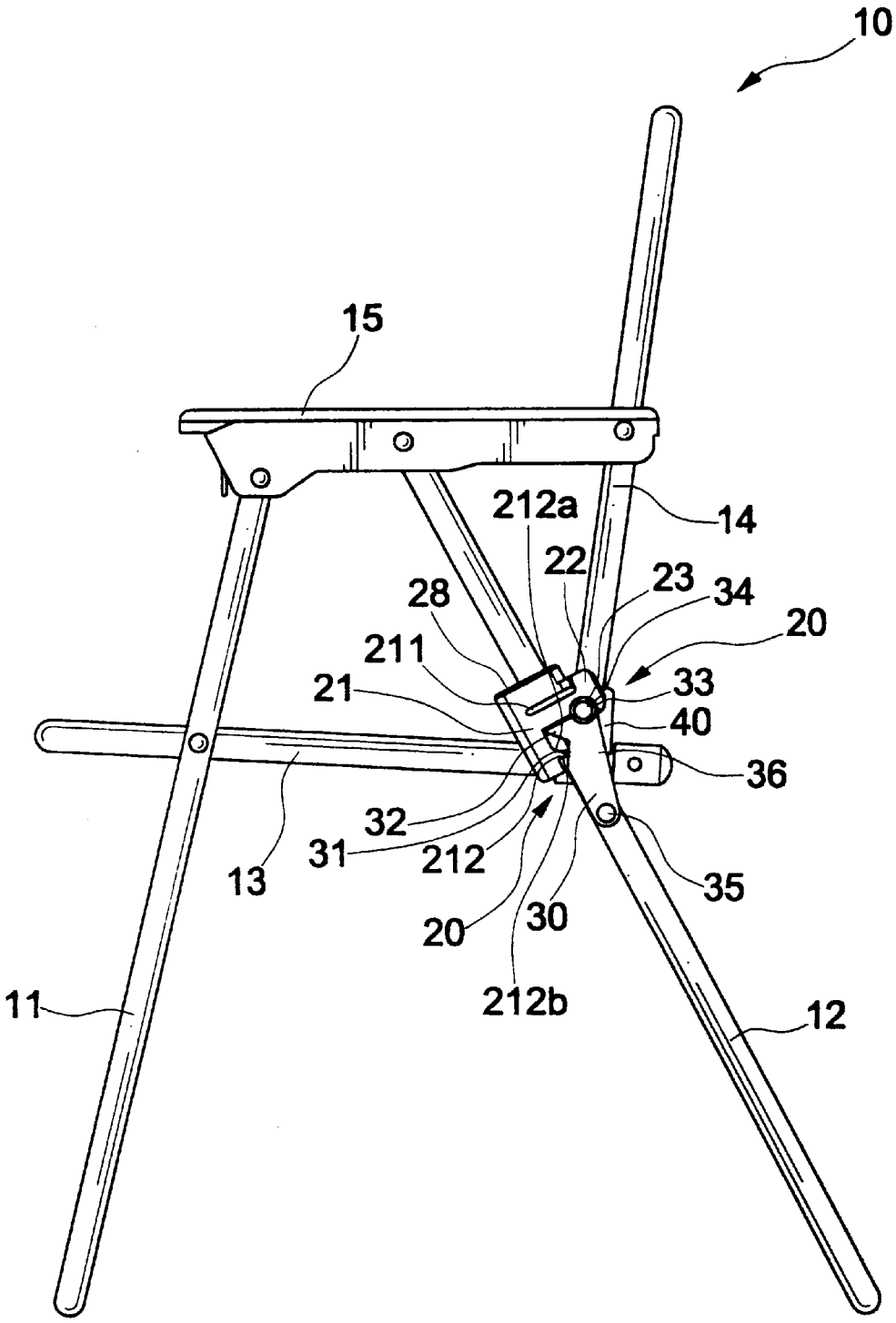
FIG. 2 is a side view of the collapsible chair in accordance with the present invention, wherein the collapsible chair is in an extended status.

Referring to FIGS. 1 and 2, a collapsible chair in accordance with the present invention generally includes a pair of front legs 11, a pair of rear legs 12, two armrests 15, a substantially U-shape seat frame 13, and a substantially U-shape backrest frame 14. In this embodiment, the front legs 11 are integrally formed with a connecting rod 11*a* interconnected between the front legs 11, thereby forming a substantially U-shape front leg frame. The rear legs 12 are integrally formed with a connecting rod 12*a* interconnected between the rear legs 12, thereby forming a substantially U-shape rear leg frame. Upper ends of the front legs 11 are pivotally connected to front ends of the armrest 15, respectively. Upper ends of the rear legs 12 are pivotally connected to intermediate portions of the armrests 15, respectively. Rear ends of the armrests 15 are pivotally connected to intermediate portions of two lateral sides of the backrest frame 14, respectively. Thus, a collapsible chair is provided.

Figure 3:
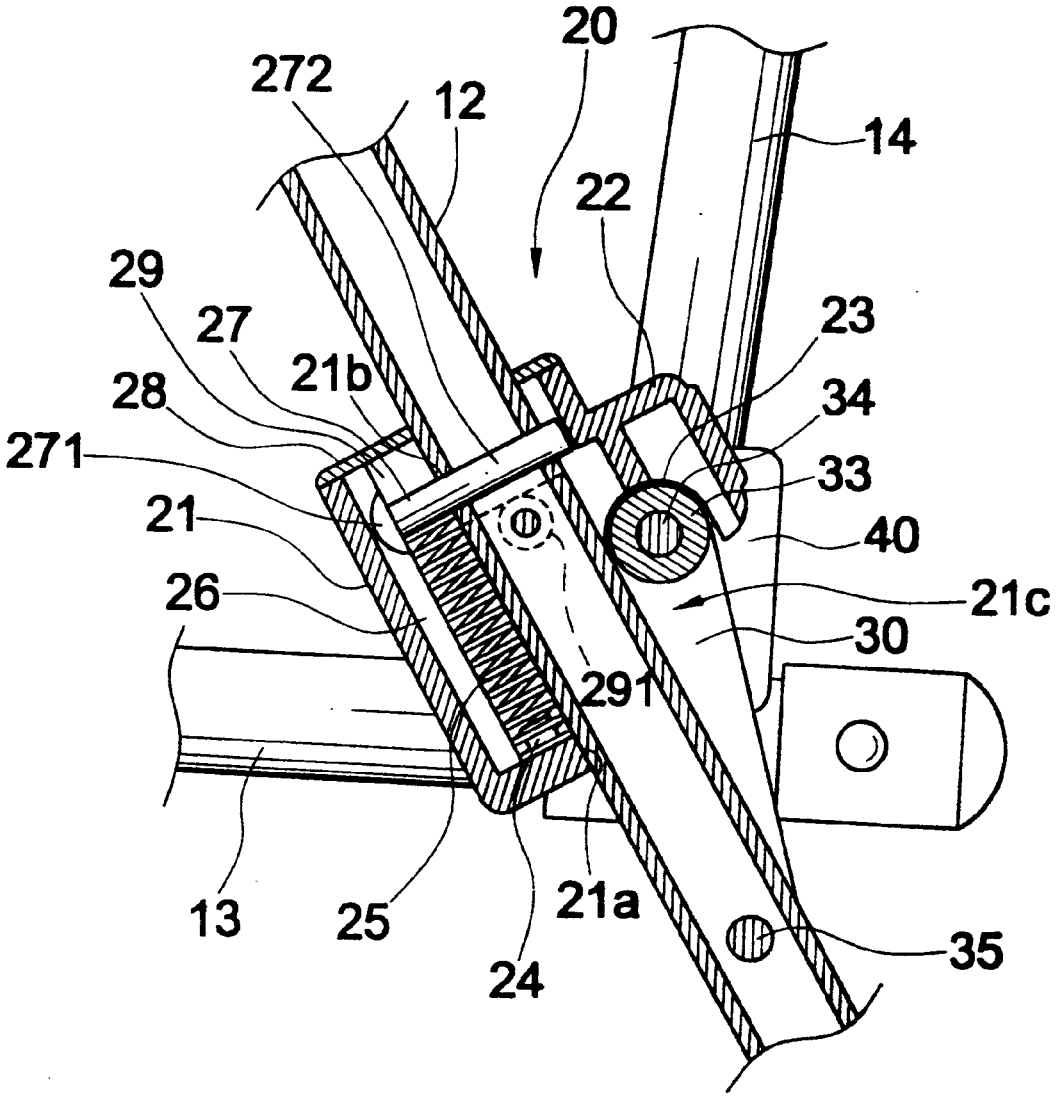
FIG. 3 is an enlarged side view, partly sectioned, of a portion of the collapsible chair, illustrating a pinch preventing mechanism in accordance with the present invention.
Figure 8:
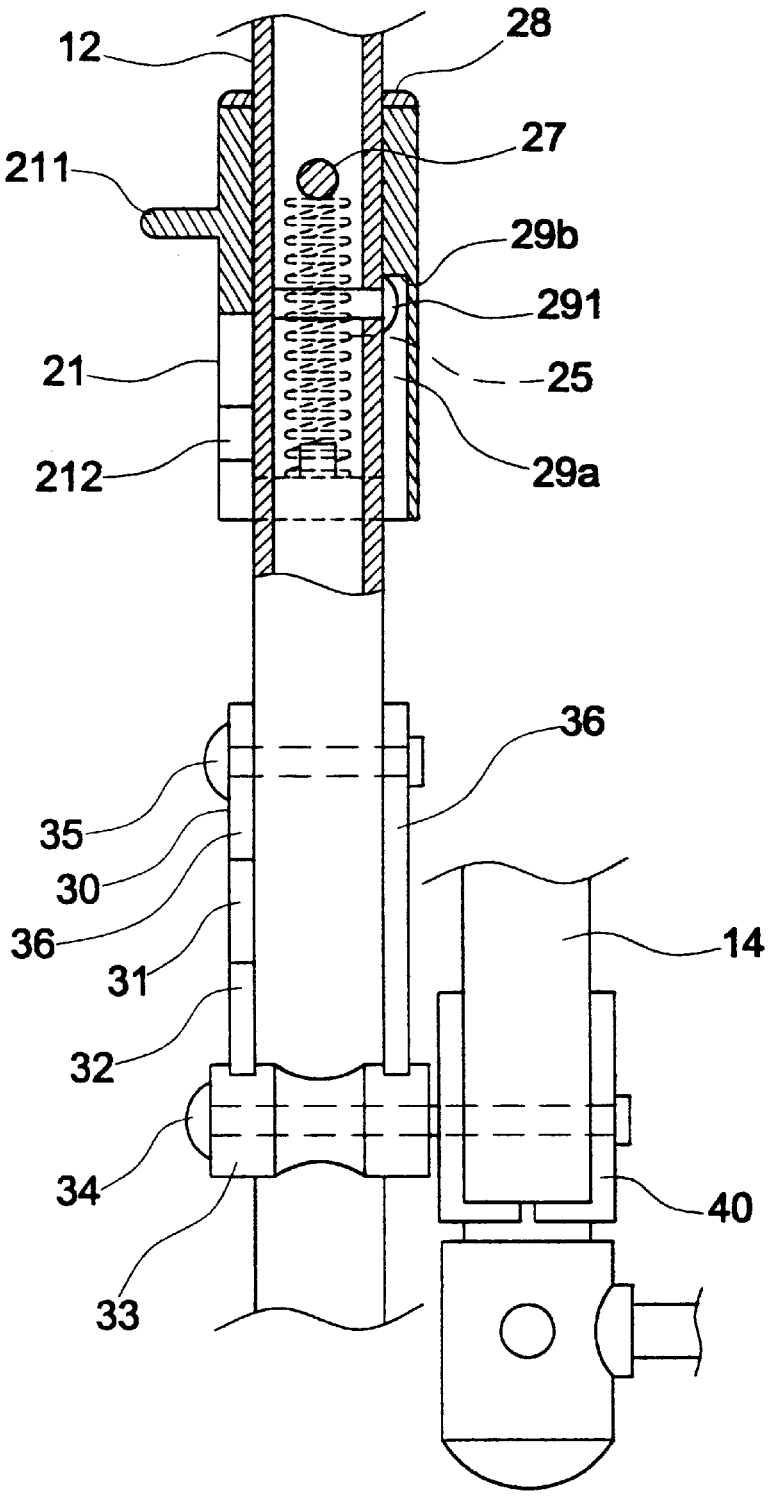
FIG. 8 is an enlarged side view of a portion of the collapsible chair, illustrating a stop in the sleeve of the pinch preventing mechanism in accordance with the present invention.

The present invention provides a pinch preventing mechanism 20 on one of the rear legs 12. The pinch preventing mechanism includes a sleeve 21 with a longitudinal hole 21*a* (FIG. 3) through which the associated rear leg 12 extends. As illustrated in FIG. 3, an inner periphery defining the longitudinal hole 21*a* includes a first compartment 29 that communicates with the longitudinal hole 21*a,* the first compartment 29 including an enlarged compartment section 26. The sleeve 21 further includes a transverse hole 21*b* through which a pin 27extends. The pin 27 includes a head 271 that is located in the enlarged compartment section 26 of the first compartment 29. Mounted in the first compartment 29 is a spring 25 that is attached between a stem portion 272 of the pin 27 and an end wall (not labeled) defining the first compartment 29*a*. Formed on the end wall defining the first compartment 29 is a peg 24 for positioning an end of the spring 25. The inner periphery defining the longitudinal hole 21*a* of the sleeve 21 further includes a compartment 29*a* (FIG. 8). The rear leg 12 further includes a stop 291 (in the form of a head of a pin or rivet) formed on an outer periphery thereof and located in the compartment 29*b,* best shown in FIG. 8. In addition, the sleeve 21 further includes a thumb-piece 211 and a locking member 22 formed on the outer periphery thereof (FIGS. 1 and 2). The sleeve 21 further includes a wedge 212 formed on the outer periphery thereof and located below the thumb-piece 211, the wedge 212 including an inclined side surface 212*a* and a bottom surface 212*b*. The locking member 22 includes a downwardly facing arcuate engaging groove 23. An end cap 28 is provided to enclose an upper end of the sleeve 21.

Still referring to FIGS. 1 through 3, the pinch preventing mechanism 20 further includes an engaging device 30. In this embodiment, the engaging device 30 includes two parallel side plates 36 located on both sides of an associated rear leg 12. Upper ends of the side plates 36 are connected by an engaging tube 33 that is extended through by a rivet 34 so as to be pivotally connected to a mounting block 40 which, in turn, is mounted to a rear end of an associated lateral side of the seat frame 13 and to which a lower end of an associated lateral side of the backrest frame 14 is pivotally mounted. Lower ends of the side plates 36 are pivotally connected to the rear leg 12 by a rivet 35. In addition, one of the side plates 36 (e.g., the outer one) includes a notch 31 having an inclined surface 31*a* configured corresponding to the inclined side surface 212*a* of the wedge 212. The sleeve 21 further includes a cutout 21*c* to expose the associated rear leg 12, so as not to interfere with pivotal movement of the engaging device 30.

The collapsible chair shown in FIGS. 2 and 3 is in a fully extended status. The spring 25 exerts a downward force to urge the engaging groove 23 of the locking member 22 on the sleeve 21 to securely engage with an arcuate surface of an upper portion of the engaging tube 33. Thus, reliable engagement between the locking member 22 of the sleeve 21 and the engaging tube 21 is obtained, as upper ends of the side plates 36 that are integrally formed with the engaging tube 33 are fixed and thus cannot pivot relative to the backrest frame 14. Collapse of the chair is accordingly prevented.

Figure 4:
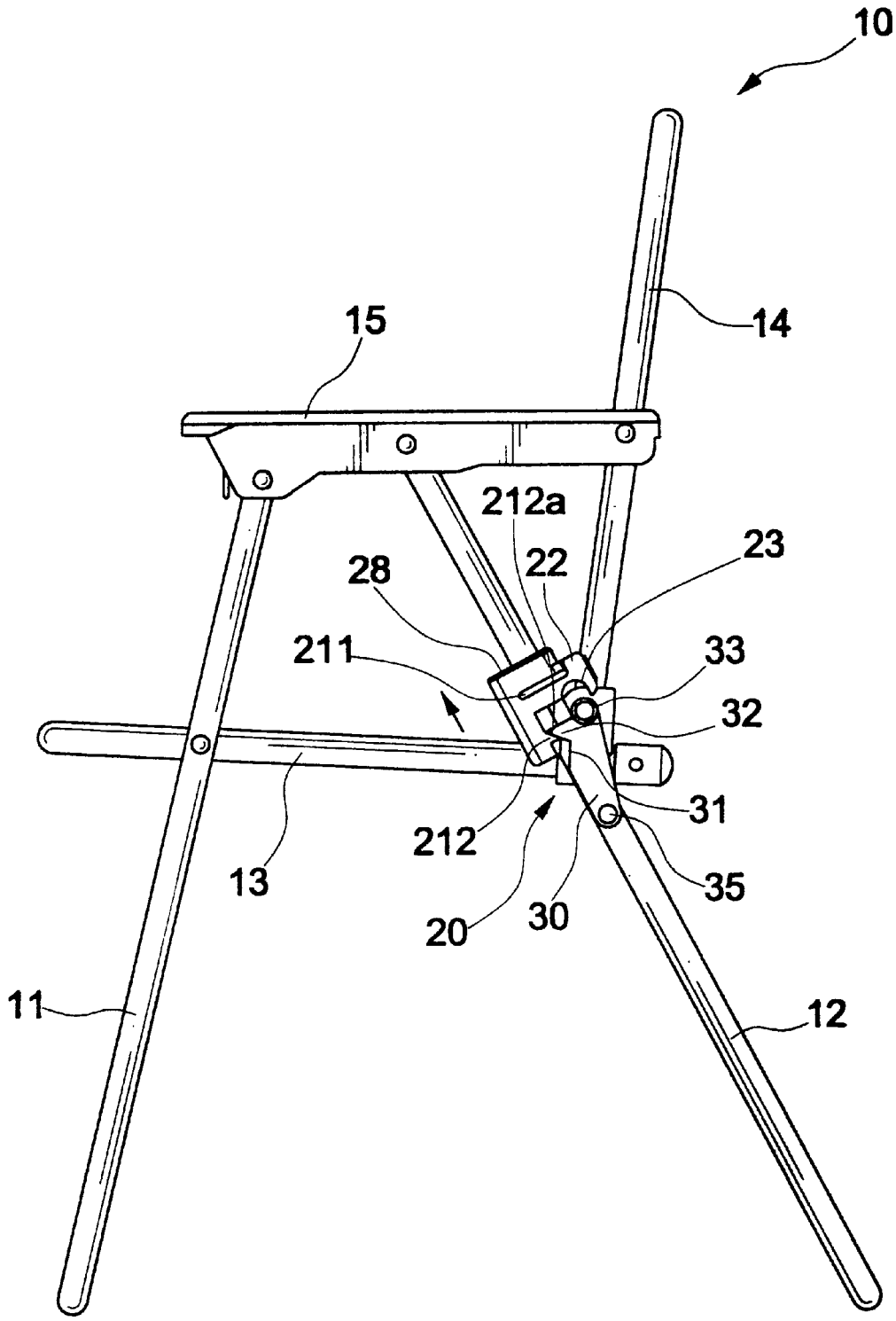
FIG. 4 is a side view similar to FIG. 2, wherein a sleeve of the pinch preventing mechanism is moved upward for collapsing the collapsible chair.

When collapsing the chair, the user pushes the sleeve 21 upward by pressing against the thumb-piece 211 with a thumb. As illustrated in FIG. 4, the inclined side surface 212*a* of the wedge 212 of the sleeve 21 slides along the inclined surface 31*a* of the notch 31 of the side plate 36. The locking member 22 is lifted upward and thus disengaged from the engaging tube 33.

Figure 5:
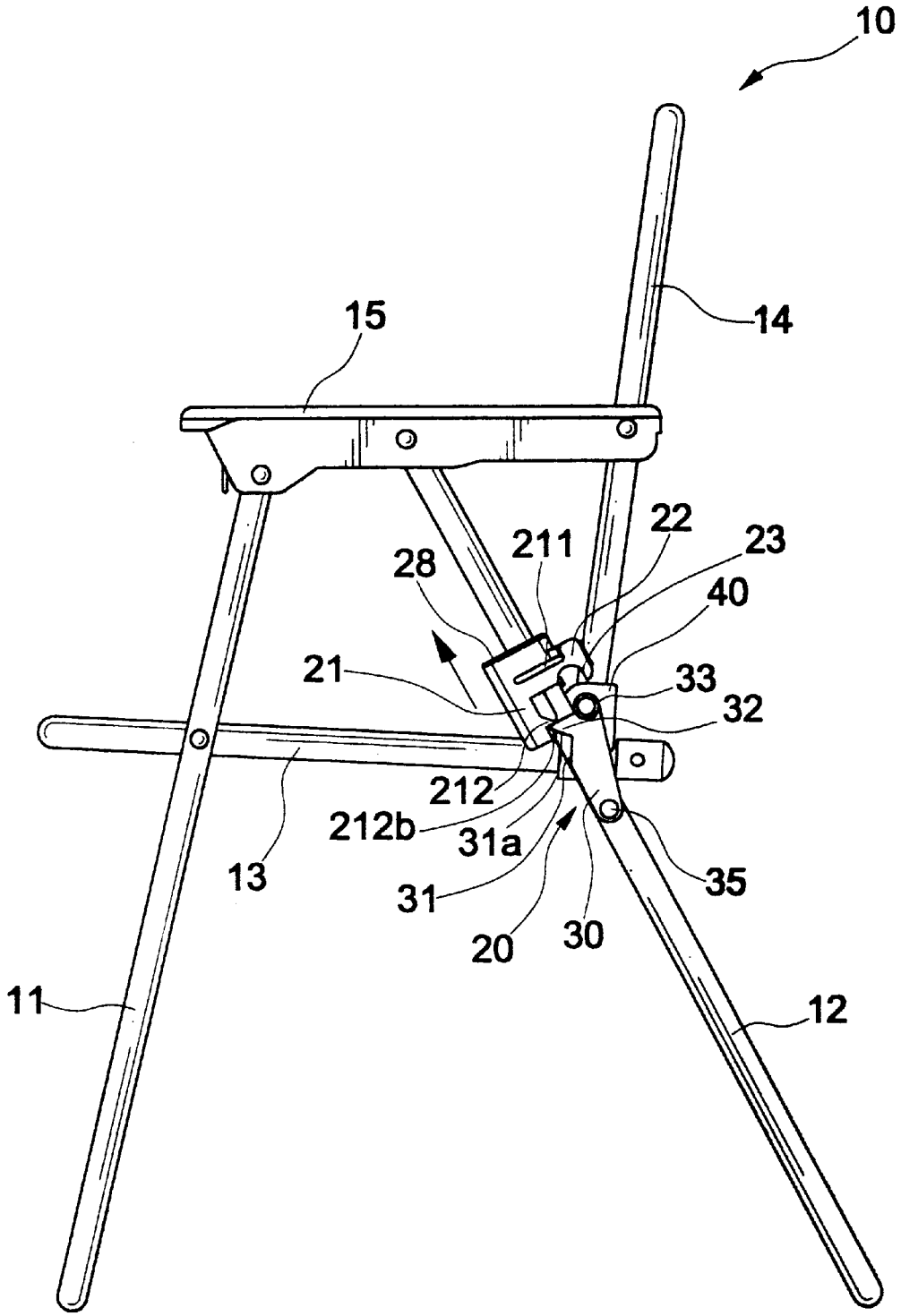
FIG. 5 is a side view similar to FIG. 4, wherein the sleeve is moved to a position allowing subsequent pivotal movements of a backrest frame and a seat frame.

Turning to FIG. 5, the sleeve 21 is moved further upward until the wedge 212 passes over the notch 31 of the associated side plate 36. Then, the spring 25 that is compressed during upward movement of the sleeve 21 exerts a downward return force to the sleeve 21 to make the bottom surface 212*b* of the wedge 212 abut against an upper side of the associated side plate 36. The sleeve 21 is retained in a level above the side plates 36 and the engaging locking member 22 retained in a level disengaging from the engaging tube 33. Thus, the upper ends of the side plates 33 of the engaging member 30 are pivotable relative to the backrest frame 14.

Figure 6:
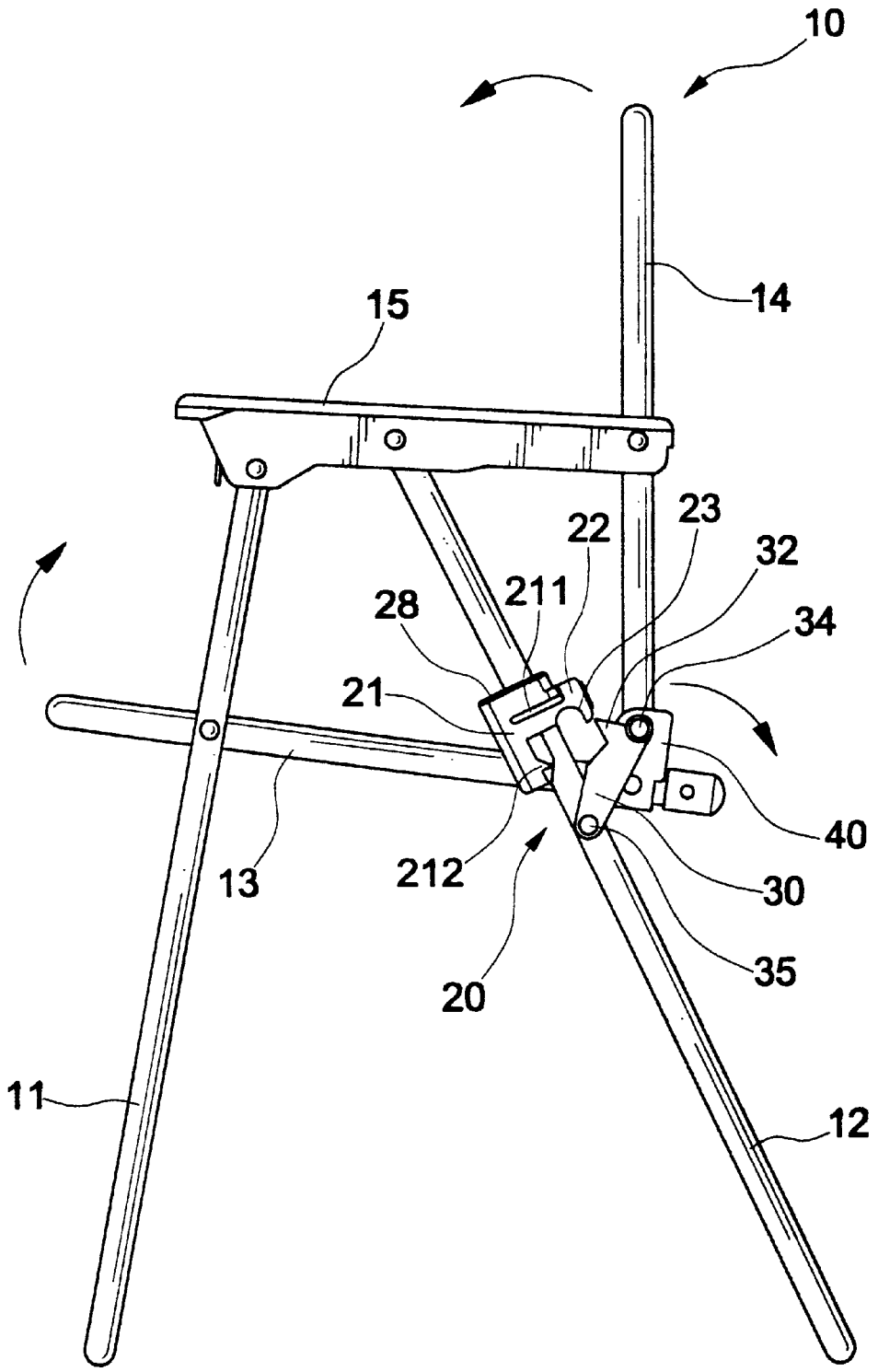
FIG. 6 is a side view similar to FIG. 4, illustrating pivotal movements of the backrest and the seat frame.
Figure 7:
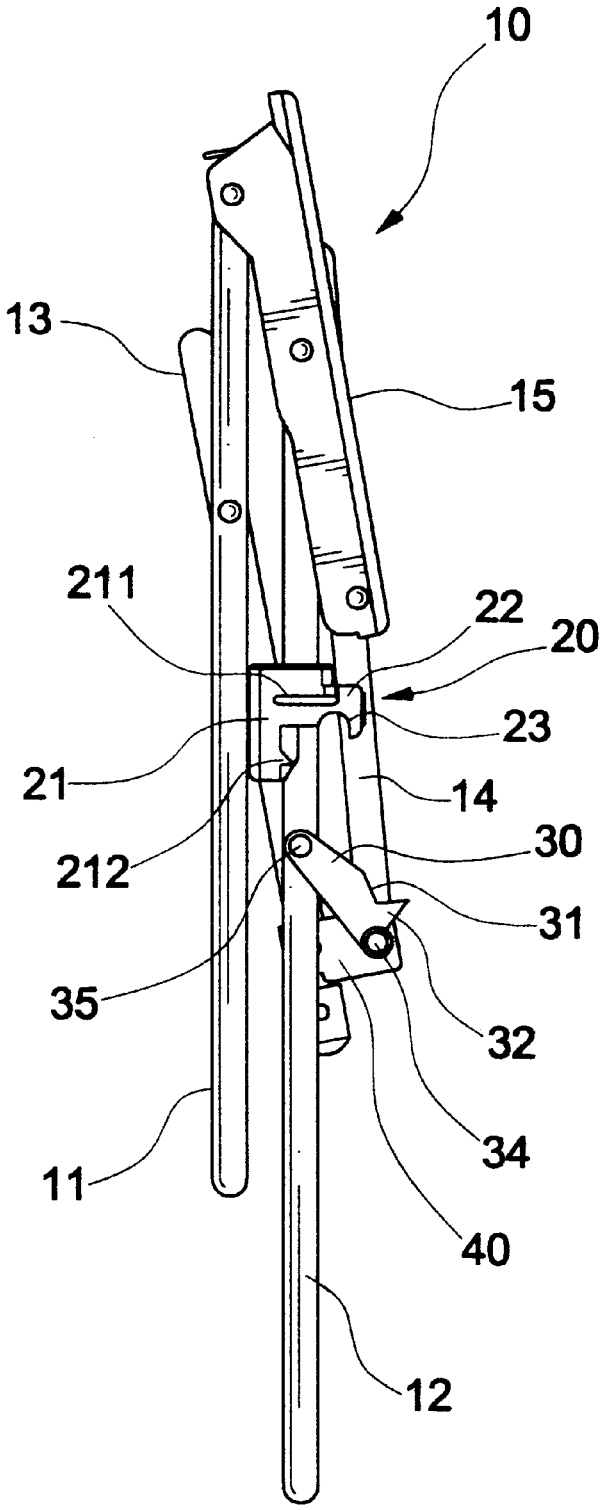
FIG. 7 is a side view of the collapsible chair in a fully collapsed status.

Turning to FIG. 6, the user then holds the backrest frame 14 and the seat frame 13 with both hands and pivot them toward each other, thereby collapsing the chair into a status shown in FIG. 7. Referring to FIG. 8, during collapse of the chair, the sleeve 21 is retained in a level above the side plates 36, an upper end wall 29*b* defining the compartment 29*a* rests on the stop 291. Thus, collapse (and re-extending) of the chair will not be disturbed by the sleeve 21.

Extending of the collapse chair can be easily achieved by grasping the backrest frame 14 and the seat frame 13 and pivot them away from each other until the chair reaches a fully extended status shown in FIG. 2. It is noted that arcuate surface of the engaging tube 33 may guide the locking member 22 to the engaged position. In addition, the locking member 22 may include a beveled or arcuate outer side that engages with the arcuate surface of the engaging tube 33 into the engaging groove 23 of the locking member 22, thereby smoothing the operation for unfolding the chair.

According to the above description, it is appreciated that the collapsible chair is reliably retained in its extended status by the pinch preventing mechanism in accordance with the present invention.

Although the invention has been explained in relation to its preferred embodiment, it is to be understood that many other possible modifications and variations can be made without departing from the spirit and scope of the invention as hereinafter claimed.

What is claimed is:

1. A collapsible chair comprising:

a backrest frame including two lateral sides each having a lower end, a seat frame including two lateral sides each having a front end and a rear end, the rear end of each said lateral side of the seat frame including a mounting block securely mounted thereon, the lower end of each said lateral side of the backrest frame being pivotally connected an associated said mounting block, two armrests each having a front end and a rear rend, the rear end of each said armrest being pivotally connected to an intermediate portion of an associated said lateral side of the backrest frame, two front legs each having an upper end and a lower end, the upper end of each said front leg being pivotally connected to the front end of an associated said armrest, two rear legs each having an upper end and a lower end, the upper end of each said rear leg being pivotally connected to an intermediate portion of the associated armrest, a pinch preventing mechanism including:

a pin fixed to one of the rear legs, a sleeve slidably mounted around said one of the rear legs and including a locking member and a wedge, the sleeve including a compartment into which the pin extends, a spring being mounted in the compartment and attached between the pin and an end wall defining the compartment, thereby biasing the sleeve downward, the wedge including a bottom surface, an engaging device including an upper end pivotally connected to said lower end of an associated said lateral side of the backrest frame, the engaging device further including a lower end pivotally connected to said one of the rear legs in a position below the sleeve, the engaging device including a notch, the wedge being engaged in the notch of the engaging device when the collapsible chair is in an extended status, the locking member of the sleeve being biased by the spring to securely yet releasably engaged with the upper end of the engaging device when the collapsible chair is in the extended status, thereby preventing collapse of the collapsible chair, whereby when collapsing the collapsible chair, the sleeve is manually moved upward along said one of the rear legs to disengage the wedge from the notch, the spring exerts a downward force to the sleeve to make the bottom side of the wedge abut against the engaging device to thereby retain the sleeve at a level in which the locking member of the sleeve disengages from the upper end of the engaging device, thereby allowing collapse of the collapsible chair.

2. The collapsible chair as claimed in claim 1, wherein the wedge includes an inclined side surface and the notch includes a correspondingly shaped inclined surface, wherein the inclined side surface of the wedge slides along the inclined surface of the notch when collapsing the collapsible chair by moving the sleeve upward along said one of the rear legs.

3. The collapsible chair as claimed in claim 1, wherein the sleeve further includes a thumb-piece formed on an outer periphery thereof to allow easy upward manual movement of the sleeve along said one of the rear legs.

4. The collapsible chair as claimed in claim 1, wherein said one of the rear legs includes a stop formed on an outer periphery thereof, the stop retaining the sleeve at a level above the engaging device when the collapsible chair is in a collapsed status, thereby allowing the collapsed chair to be extended directly.

5. The collapsible chair as claimed in claim 4, wherein the sleeve includes a second compartment, and wherein an upper end wall defining the second compartment abuts against the stop when the collapsible chair is in the collapsed status.

6. The collapsible chair as claimed in claim 1, wherein the sleeve includes an end cap mounted to an upper end thereof.

7. The collapsible chair as claimed in claim 1, wherein the engaging device includes two parallel side plates between which said one of the rear legs extends, each said side plate includes an upper end and a lower end, the upper ends of the side plates of the engaging member being connected by an engaging tube that is integrally formed with the upper ends of the side plates and pivotally connected to the lower end of the associated lateral side of the backrest frame, the lower ends of the side plates of the engaging member are pivotally connected to said one of the rear legs, the notch being defined in one of the side plates of the engaging member.

* * * * *